US007036696B2

(12) United States Patent
Lam

(10) Patent No.: US 7,036,696 B2
(45) Date of Patent: May 2, 2006

(54) FOLDABLE AND SELF-OPENING GARMENT HANGER

(76) Inventor: Daniel Lam, 21065 Rainbow Dr., Cupertino, CA (US) 95014

( * ) Notice: Subject to any disclaimer, the term of this patent is extended or adjusted under 35 U.S.C. 154(b) by 111 days.

(21) Appl. No.: 10/835,758

(22) Filed: Apr. 29, 2004

(65) Prior Publication Data

US 2005/0242135 A1 Nov. 3, 2005

(51) Int. Cl.
*A41D 27/22* (2006.01)

(52) U.S. Cl. ..... 223/94

(58) Field of Classification Search ..... 223/94, 223/89, 90

See application file for complete search history.

(56) References Cited

U.S. PATENT DOCUMENTS

| | | | | |
|---|---|---|---|---|
| 1,097,889 | A * | 5/1914 | Sommer | 223/94 |
| 2,448,234 | A * | 8/1948 | Pandele | 223/94 |
| 2,716,513 | A * | 8/1955 | Braunstein | 223/94 |
| 3,705,673 | A * | 12/1972 | Mohammar | 223/94 |
| 3,802,610 | A * | 4/1974 | Love et al. | 223/94 |
| 4,114,786 | A * | 9/1978 | Wiese | 223/94 |
| 4,186,857 | A * | 2/1980 | Helms, Jr. | 223/94 |
| 4,586,524 | A * | 5/1986 | Smith | 223/94 |
| 4,645,106 | A * | 2/1987 | Pawl | 223/94 |
| 5,044,534 | A * | 9/1991 | Hwang | 223/94 |
| 5,383,584 | A * | 1/1995 | Adams | 223/94 |
| 5,397,037 | A * | 3/1995 | Ozawa | 223/94 |
| 5,480,076 | A * | 1/1996 | Siegel et al. | 223/94 |
| 5,690,257 | A * | 11/1997 | Ward | 223/94 |
| 6,050,460 | A * | 4/2000 | Licari et al. | 223/94 |
| 6,427,882 | B1 * | 8/2002 | Harvey | 223/85 |
| 6,540,121 | B1 * | 4/2003 | Harvey | 223/85 |

* cited by examiner

*Primary Examiner*—Danny Worrell
(74) *Attorney, Agent, or Firm*—George M. Steres

(57) ABSTRACT

A foldable and self-opening hanger has two arms that fold down to a closed position away from the hanger's hook member with adjacent bottom arm edges proximal to each other. The arms are closed manually in opposition to a restoring force provided by an internal resilient member that tends to move the arms away from each other toward an open position suitable for hanging light garments such as shirts and blouses that exert opposing forces on the arms less than restoring force provided by the internal resilient member. For heavier garments, a lock-release mechanism is provided that holds the arms in a fully open-locked position that supports coats, heavy sweaters and the like. A pair of release buttons on opposite sides of the hanger release the lock-release mechanism allowing arms to be folded manually to the fully closed position so the hanger may be inserted into the neck of a garment without opening buttons or zippers. The arms then can be released from the closed position by merely letting go of them and allowing the resilient member to spread the arms open to support the garment to be hung.

7 Claims, 4 Drawing Sheets

FOLDABLE AND SELF-OPENING GARMENT HANGER

BACKGROUND INFORMATION

BACKGROUND OF THE INVENTION

Field of the Invention

The present invention relates to hangers used in clothing stores, dry cleaning establishments, and more particularly household use.

Garment hangers are commonly used in clothing stores, garment factories, garment-cleaning companies, and in common households. Conventional fixed hangers are normally used to hang many different types of garments: suits, sweaters, T-shirts, dress shirts, dresses, blouses, and turtle neck sweaters, among them. It is particularly difficult to use conventional hangers on some types of garments, e.g. T-shirts and pull-over sweaters, due to the stresses exerted on the neck-opening for example, when attempting to insert a fixed arm hanger through the neck-opening. Some garments can be damaged when arranging on a fixed arm hanger. For example, the looped weave of a knitted sweater will easily tangle in the hook possibly causing threads to break or be pulled out of the weave.

There are many varieties of foldable hangers that have not found acceptance in the market. The hangers shown in existing patents are either not cost-effective, are not reliable in performance, or have no redeeming return on investment to the garment industry, consumer, or otherwise. Some types of collapsible hangers require excessive garment manipulation to place on such hangers. Hangers with shortened arms are also unsatisfactory as other garments with large or scooped neck-openings can easily fall off.

Accordingly, it is desirable to have an economic, foldable and self-opening hanger.

BRIEF SUMMARY OF THE INVENTION

The present invention is a foldable and self-opening hanger that uses a few simple parts. The number of garments that can utilize this feature is very large, for example, some types are suits, sweaters (standard and turtleneck), blouses, dress shirts, T-shirts, and lingerie. The foldable and self-opening hanger prevents stretching of the collar. The foldable and self-opening hanger is economical to manufacture and very convenient for the industry and consumer to use.

Advantageously, the present invention is very easy to use by folding down the two arms (right and left), holding them together while insert the hanger into a collar or neck of a garment, once the two arms are placed inside the garment collar, or neck, and merely released, the arms will automatically open by spring action of a resilient member inside.

Another advantage of the present foldable hanger invention is that it provides opening resilience sufficient to support light garments such as shirts and blouses without further attention.

Yet another advantage is the lock-release mechanism which is engaged by spreading the hanger arms to a fully open-locked position that cause one or more inward projecting inner studs inside the arms to bear against one fixed face of an internal anchor member, preventing the arm from rotating toward the closed position with both arms together.

The blocking stud and blocking face provided by the present invention are constructed to minimize wear and extend the life of the present foldable hanger invention.

Other advantages of the present invention will becomes apparent from the detailed

DETAILED DESCRIPTION OF THE INVENTION

Figure 1:
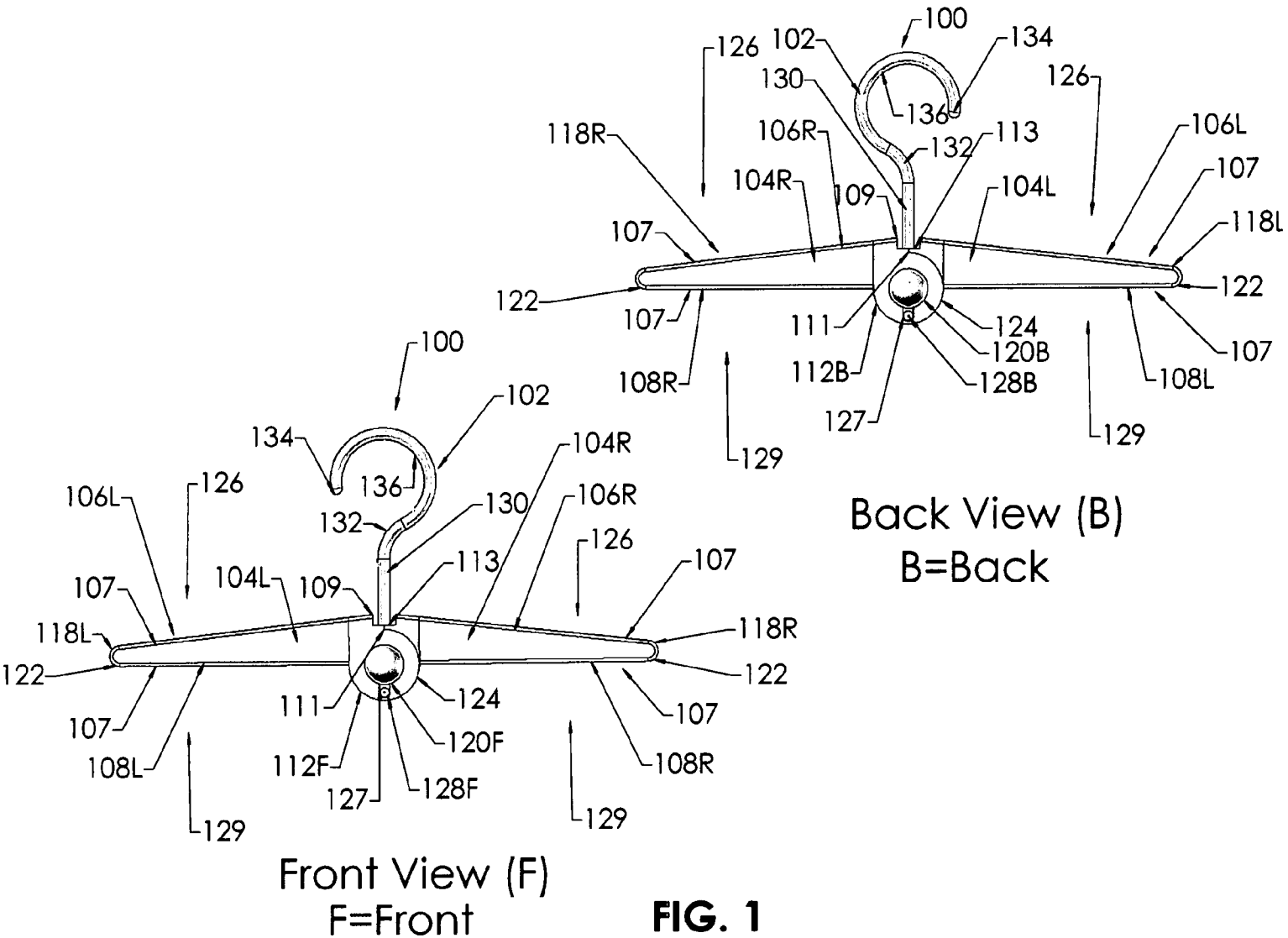
FIG. 1 front and back elevation views of an embodiment of the present hanger invention in the open-lock position.
Figure 2:
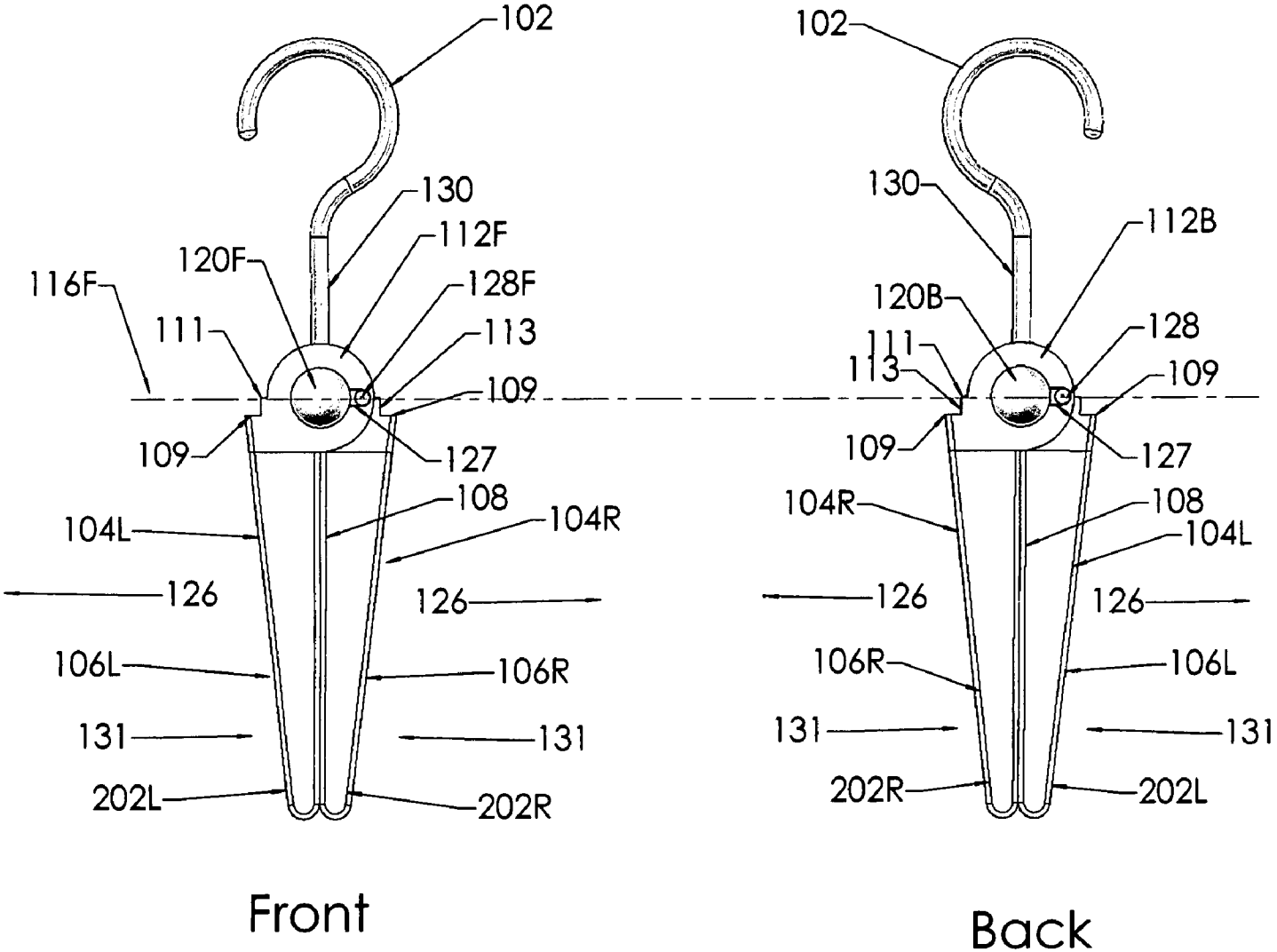
FIG. 2 front and back elevation views of an embodiment of the present hanger invention in the fully closed opening-tension mode.

In FIG. 1, FIG. 2, FIG. 3, and FIG. 4 there are shown views of a preferred embodiment 100 of the present collapsible hangar invention. FIG. 1 shows front and back views of the hangar 100 in a fully open locked mode in accordance with the present invention. FIG. 2 shows front and back views of the hangar 100 in the fully closed mode ready for insertion into or removal the neck of a garment.

With regard to FIG. 1 there is shown a front (F) and back (B) view of one embodiment 100 of the present collapsible hangar invention in a fully open and locked position (the open-lock mode) ready to accept and support clothes as an ordinary hangar would. FIG. 1 shows the front (F) and back (B) elevation views of the hanger 100 with a hook member 102 and two opposed arms, 104 right and 104 left, extending right to left in the front view and left to right in the back view. The orientation of the hanger 100 is that of normal use, that is with a hook member 102 centered between, and vertically above the adjacent, proximal ends of two depending hanger arms 104R and 104L. The arms 104 right and 104 left have spaced apart upper and lower edges 106 right, 108 right, 106 left, 108 left. The upper and lower edges are not parallel but are disposed at a slight acute angle 107 from respective distal ends 118. Each arm is notched at its proximal upper edge to form a top shoulder 109 set back from the hook member 102 and recessed below the top of the arms.

The proximal end of the outer wall of each arm has flange portion 112 whose perimeter extends around about ¾ of a circle The bottom surface of shoulder 109 extends to a proximal 2nd shoulder 111 forming a load-bearing face below the bottom of 109 to perpendicular to the base edges 108 arms and coplanar with the plane bisecting the hanger.

On the opposite arm 104 and on the same (front or back) side, a proximal load-bearing finger 113 projects from the opposite top shoulder 109 as an extension of the opposing arm's outer wall on the same side of the hanger. The bearing face of 2nd shoulder 111 and the complementary bearing finger 113 distribute loads caused by an attempt to force the arms to rotate toward the hook member beyond the natural lock position. They are proportioned so that a reasonable load induced by such an attempt will be supported by the strength of the material chosen for the hanger.

The proximal end of the outer wall of each arm 104 has a flange sector 112 whose perimeter has a circular extent from the bottom of the load bearing face 111, about ½ pi-radians around to the base edge 108 of its own arm. The circular flange sector 112 on the front and the back has its center coaxial with a pivot axis 116 perpendicular to the plane of the arms 104. A pair of opposing rivets, 120 are centered on the flanges 112, and fixed to the interior of the hanger. The rivets 120 are sized to fit closely, but freely through the center of a respective flange in order to give the flanges 112 and thus the two arms 104, the capability to rotate with respect to the hanger hook, if not otherwise locked together. For reference purposes, a baseline 122 is shown that intercepts the pivot axis 116 and is co-linear with the base edges 108 when the hanger is locked, as in FIG. 1. The pivot axis 116 is the center about which the base edges 108 move toward each other and the arms 104 rotate away from the lock position of FIG. 1 under the influence of forces from above (indicated by arrows 126 on the top edges 106), when they are released as is described below.

A longitudinal release lever 127 in the form of cantilever tongue is defined in the plane of the flange by a U-shaped slot extending through the flange plane. The tongue has a release button 128 projecting outward from the outer surface of the flange at its distal end. The longitudinal aspect of the tongue is centered on the pivot axis, spaced away from the flange's center, in line with the pivot axis 116 but on the side opposite to the hook stem, and extends distal from the axis 116 to reach adjacent to, but short of the flange perimeter 124. Part of the slot defining the tongue 127 is partially covered in FIG. 1 and FIG. 2 by the head of rivet 120. Thus, the release tongue 127, flange 112 and arm 104 are unitary and move together in rotation, about the central axis 116.

With regard to FIG. 2 there are shown front and back views of the hangar 100 in which the arms 104 are rotated down to a fully closed position with the base edge 108 of each arm in facing contact with its opposite base edge 108. The base edges 108 are aligned with the hook stem 130 since the rotation axis 116 is centered on the hanger hook stem, in this embodiment. Keeping the hanger in this closed position requires the arms to be held together against the urging of an internal spring member, described below, by exerting equal and opposing forces indicated by arrows 202 against the two top arm edges 106. Typically the arms would be held in the closed position shown in FIG. 2 by a person's hand (not shown) wrapped around the arms near their distal ends, in order to pass the distal end of the hangar arms into or out of the neck of a garment.

The flanges 112 and their extending arms 104 are arranged to pivot around a pivot axis 116, toward or away from the hook member 102. The arms tend to rotate toward each other in the direction of the closed position of FIG. 2 under influence of forces exerted from above toward the top edges 106 of the hangar arms as indicated by arrows 126, when front and back release buttons 128 on opposite sides of the hanger are depressed toward the interior of the hangar sufficient to release the arms from the lock position shown in FIG. 1. Release buttons 128 are part of a releasable lock mechanism for hangar 100 and is described further below with reference to FIG. 3.

A resilient member in the hanger 100 (described below) exerts restoring forces 129 coupled between the pivot axis and the opposite arms, where the restoring force tends to rotate the arms toward the lock position of FIG. 1 when the forces 126 are overcome by the restoring force of the resilient member.

The hook member 102 may be formed from a round rod of semi rigid material such as metal or plastic. The rod 102 has an intermediate length longitudinal segment 130 extending distal from between the two hangar arms, and is centered on the pivot axis 116 and is perpendicular to the baseline 122. Between a distal end 132 of the intermediate length segment 130 and a free end 134, the rod 102 forms a curved segment 136 that is doubly curved, first toward one of the arms of the hangar and then reversing curvature to extend back toward the other, opposite arm, extending thereby over about three-quarters of the perimeter of a circle centered on the central pivot axis. The free end 134 and the distal end of the segment 130 are spaced apart so that the hook 102 can be placed over a clothes rod found in a typical closet.

The hook portion is formed so it will partially encircle a common clothes rod or clothes peg in a closet while leaving enough separation between the free end of the hook and the upper end of the shaft to remove the hook from the rod or peg. The hook shape may be other than circular as long as the free end of the hook curves sufficiently around its most distal extent from the body piece, to keep the hanger and the clothes it is supporting, safely suspended on the clothes rod whenever it is disturbed slightly, from the vertical (in the plane defined by the curved hook portion).

Referring to FIG. 2, the hanger 100 is shown in the closed position with both arms having bottom edges contacting the other.

The release buttons 128 on the front and back of hanger 100 are unitary with the flange and the arm on that side and therefore rotates together with them around the pivot axis from the fully open and locked position of FIG. 1 to the fully closed position of FIG. 2.

Figure 3:
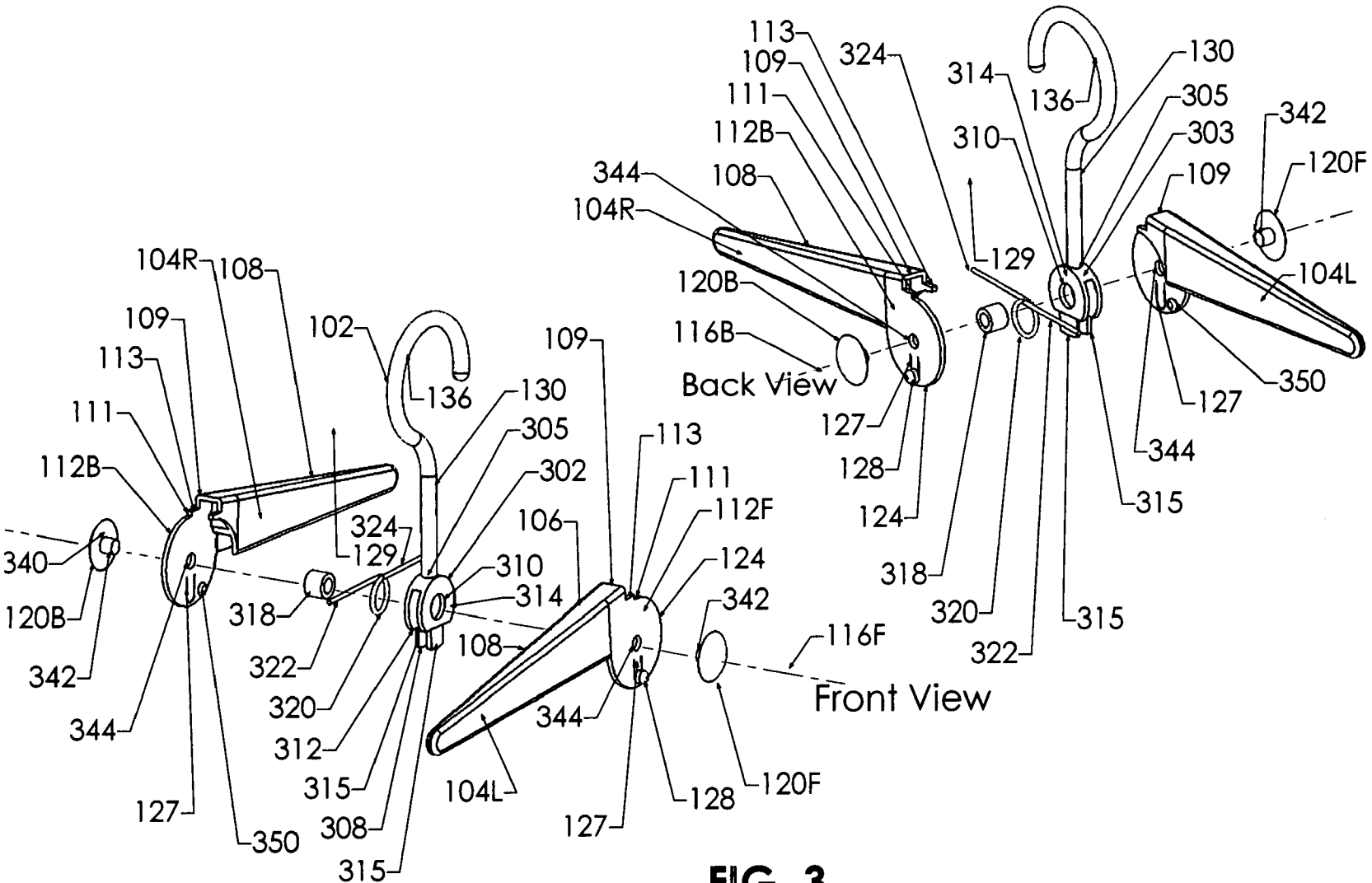
FIG. 3 front and back elevation perspective views of the hanger in FIG. 1.

FIG. 3 is an exploded front and back perspective of the hangar 100 shown in FIG. 1 in which the same elements have the same reference labels.

An inner anchor body member 302 is disposed between the two flanges. Anchor 302 defines an open end, upside down lateral channel 304 below a top cross piece 305 as the channel base between two spaced apart, front and back sidewalls 306*f*. The cross piece 305 is located above the pivot axis 116. The sidewalls 306 extend parallel and distal from the cross piece 305 on opposite sides of the stem 130 axis perpendicular to the pivot axis 116. The channel sidewalls 306 have an upper portion 314 and a lower portion 315. The lower portions 315 extend away from the pivot axis 116 to respective rounded free ends 308 distal to the pivot axis. The upper portion 314 of each sidewall is a planar, parallel pivot mount member, each defining a cylindrical borehole 310 coaxial with pivot axis 116, the borehole of each sidewall being the same diameter. A flat lower face 312 is perpendicular to the upper portion of each sidewall and located parallel to and below the pivot axis. The lower face 312 defines the interface between upper 314 and lower 315 portions of each anchor sidewall 306. The lower portion of each sidewall is a rectangular, blocking cantilever 315 projecting from its fixed end at face 312 to its distal free end 308. Each cantilever 315 is formed to be laterally rigid but axially flexible with respect to the pivot axis. The cantilever 315 is preferably formed with a wedge-shaped cross-section as described further below.

Lateral channel 304 is perpendicular to the pivot axis with its open-end facing down. Top crosspiece 305 of the channel provides a base to which the stem 130 is fixed at its lower end. A cylindrical tube 318 with flat, opposite end faces is mounted inside the bore holes 310, with its end faces coplanar to the outside surfaces of the sidewalls 314.

The two channel sidewalls 306 are spaced apart to receive a spring coil 320 disposed around the mounting tube. The spring coil has a pair of lateral spring arms 322, 324 extending in opposite directions in the channel 304 parallel to the sidewalls 306 and below the top cross piece 305. The spring coil has a winding diameter larger than the OD of the cylindrical mounting tube 318.

The two opposing rivets, 120, are located at the front and back of the hanger 100 and centered on the pivot axis 116. The rivets 120 have flat, smooth faces 340 that fit slidably proximal to the outer surface of the flanges and have short posts 342 that extend to fit rotatably, through rivet apertures 344 formed in the center of the flanges. The rivet posts are sized to be pressed into and permanently fixed into the ID of tubular core member 318. The posts can be fixed by glue, soldering or press-fit by conventional means. The rivets are fixed into the mounting tube ID so that respective rivet faces 340 are spaced away from the corresponding opposite anchor body sides and the end faces of the tubular core member 318 are sufficient to allow the flanges 112 to slidably rotate. It is sufficient to allow spacing equal to the thickness of the flange plus an allowance tolerance about 0.01 inches.

Figure 4:
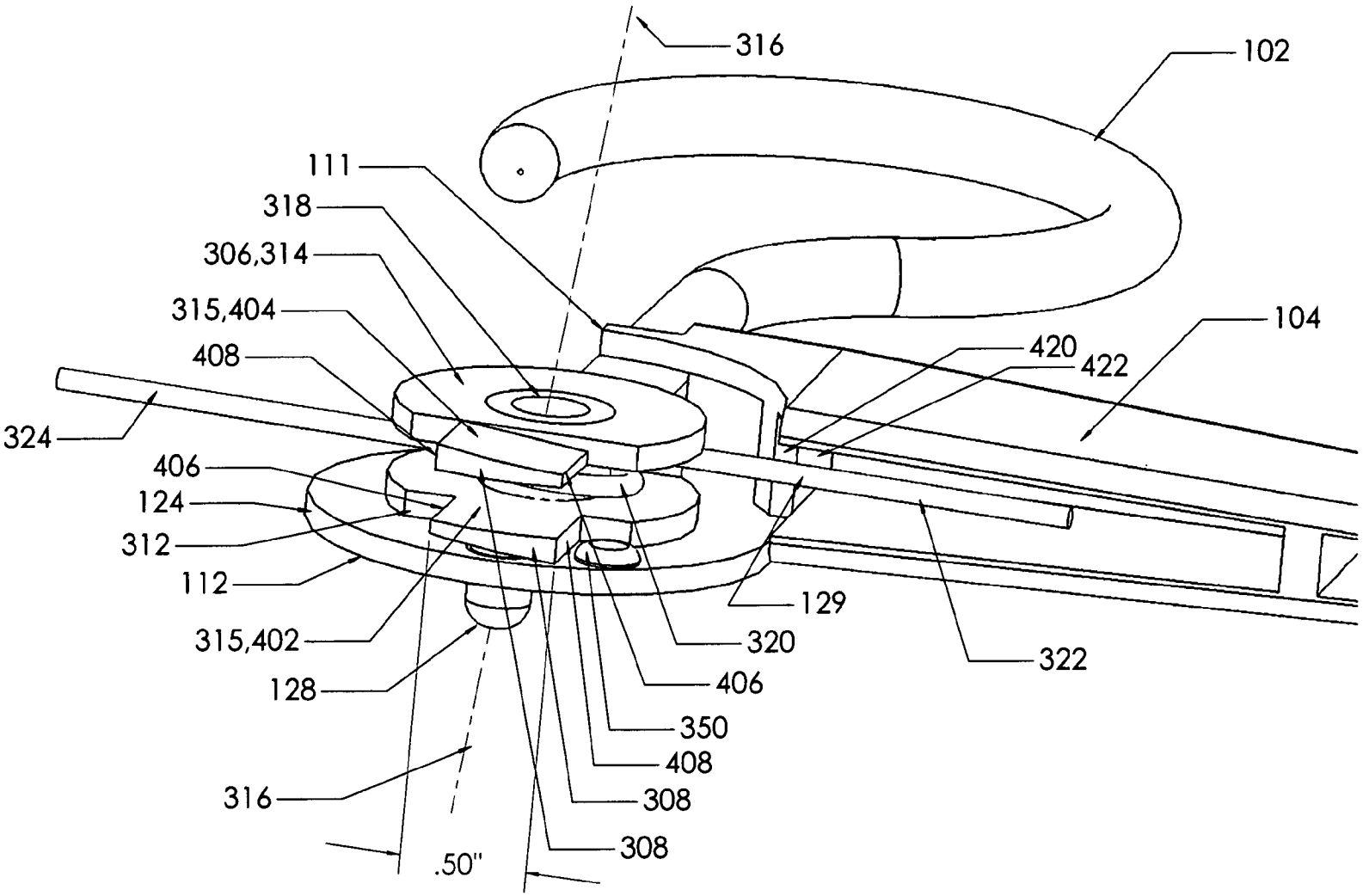
FIG. 4 illustrates a bottom perspective view of one arm and the anchor body of the hanger in FIG. 1.

Referring now to FIG. 2, FIG. 3, and FIG. 4, a blocking stud 350 is mounted on the inside of each of the flange's inner surfaces and projects inward there from to a depth that is a significant fraction of the thickness of the adjacent anchor body sidewall 306. For one preferred embodiment of the present invention the blocking stud projection depth is about (Daniel, what is the dimension of the stud projection?) and the wall thickness is about (Daniel, what is the preferred wall thickness?) Each stud 350 is located on the inside of its flange adjacent to, but not touching, the locking cantilever 306 disposed on the same side of the anchor body as the stud's flange, when the arm and supporting flange are in the open-locked position with respect to the anchor body. The stud is proportioned so that it provides an immovable impediment to rotational, closing movement of the arm on which it is mounted when the flange 112 on which the stud 350 is mounted rotates the arm toward the closed position of FIG. 2 from the open-locked position of FIG. 1 and the blocking edge of the adjacent wedge cantilever 315, contacts it's the adjacent blocking stud 350.

The coil spring 320 and the spring arms 322, 324 are proportioned so that the oppositely directed spring arms 322, 324 contact the respective opposite underside of the hanger arms 104. The spring arms 322, 324 thus provide restoring force 129 to each hanger arm tending to cause them to move toward the fully open-locked position of FIG. 1 when the restoring force 129 exceeds the load force 126 exerted by clothes hung on hanger 100.

The release cantilever tongue and the locking cantilever cooperate to release a hanger arm from the locked position of FIG. 1, when the release button 128 of one tongue 127 is pressed inward toward the anchor body and the inside of that tongue bears against the facing outside surface of blocking wedge 314 disposed on the same side of the anchor body, with sufficient force to move that locking cantilever wedge inward, toward the anchor body a sufficient distance so that the adjacent blocking stud 350 on that side of the anchor body can rotate past the wedge when rotating from the lock open position of FIG. 1 toward the closed position of FIG. 2.

This provides an easy means to close the hanger arms by merely pressing inward on the two release buttons while applying closing forces 126 sufficient to overcome the restoring forces 129 provided by the spring arms acting on the underside of the hanger arms on either side of the anchor body. The closing forces can be provided manually with one or both hands of a person.

With regard to FIG. 4, in addition to the same elements of previous figures having the same reference numbers, there is shown an underside perspective view of the hanger 100 with the back arm 104 of FIG. 1 removed. This view shows more clearly the lower portion of the sidewalls 306 with the rectangular cantilever wedges 315 and one of the two locking studs 350. The discussion here of one side wall 306 and its cantilever wedge 315 applies equally for the ones on the opposite arm 104 since the arms are mirror images of each other; thus the description of one arm and its interaction with cooperating elements is sufficient for both arms.

Each cantilever wedge 315 on the front or back of hanger 100, and the associated locking stud 350, the cantilever lever 127 and the release button 128 on the same front or back side form parts of the lock-release mechanism of the anchor body 302 referred to above with reference to FIG. 1. In accordance with the present invention, each wedge 315 has opposite wedge faces: an inside face 402 and an outside face 404. Inside face 402 is a coplanar extension of the inside surface of the upper portion of sidewall 306. The wedge faces 402, 404 extend distal from the chord face 312 to the free end 308 between two opposite edge faces: an entry face 406, and a blocking face 408, defining a blocking cantilever cross section. The two cantilever edges 406, 408 are spaced apart by a width, Wb, Wb and the location and size of the stud 350 are selected so that blocking edge 408 faces one proximal side of the edge perimeter of the blocking stud 350 when the arm is in the fully open, latched mode, and the entry edge 406 faces an opposite proximal side of the blocking stud edge perimeter when the arm and stud are in the fully closed position.

Blocking edge face 408 preferably has the same thickness as the upper sidewall portion. The different thickness of the entry face and the blocking face give the lower sidewall portion 315 its wedge-shaped cross section. The blocking stud 350 on the adjacent flange extends inward from the inside surface of that flange to a stud depth that is a significant proportion of the sidewall thickness.

The stud 350 is located adjacent to the blocking edge 408 when the flange is in the open-locked position. The blocking edge 408 is proportioned so that it provides an immovable impediment to the stud 350 to move over, or though, it when the flange 112 rotates the stud 350 from the open-locked position toward the closed position to contact the blocking edge 408.

Entry edge face 406 is preferably a narrow edge, thinner than the thickness of the upper sidewall portion and is disposed distal to and facing away from blocking stud 350 on the inside surface of the adjacent flange 112 when the arm is in the open, locked position of FIG. 1.

The projection of the stud inward from the inner surface of its flange and the respective thickness of the entry edge 406 and blocking edge 408 and the width of the blocking cantilever arm 315 between the entry edge 406 and blocking edge 408 are proportioned so that the entry edge 406 will clear the stud 350, when the stud is rotated toward the open-locked position of FIG. 1 from the closed position of FIG. 2 or a less than fully open, intermediate closed position. The thickness of entry edge 406 is less than the difference between the thickness of the blocking edge and the projecting depth of the stud 350. Continued rotation of the stud over the entry edge 406 and the slanted, outside wedge face 404 will cause the stud 350 to begin to come into contact with the outside wedge face 404 and then will cause the wedge 315 to deflect inward as the wedge face rides along the rotating stud. The wedge 315 continues to deflect inward with further rotation of the arm and stud 350 until the stud passes beyond the blocking edge 408, where it resiliently returns to its original, undeflected state, positioning the blocking edge 408 facing the proximal edge of stud 350 in the latched, fully open mode as an immovable impediment to closing rotation of the stud 350.

The slanted outside wedge face and the narrower entry edge reduce frictional wear on both the entry edge 406 and stud 350 thereby potentially extending the useful life of the present hanger invention.

These proportions therefore make it easy to put the hanger arms in the open-locked position from a fully-closed or intermediate closed position merely by rotating the arms into the open-locked position, taking advantage of the automatic deflection of the blocking wedge provided by the angled wedge face established by the different edge thickness 406, 408. Only when it is desired to close the hanger arms is it necessary to operate the release buttons 128.

FIG. 4 shows more clearly the restoring force 129 supplied by one end (spring end 322) of the resilient coil spring 320 of this embodiment being applied to a lower bearing edge 420 of a supporting rib 422 molded integrally with the two side panels of 104. Besides providing the lower bearing surface 420 the rib 422 provides additional stability and strength for the arm 104 against twisting and bending forces tending to deform the arm 104.

Returning again to FIG. 1, another of the advantages of the present invention is shown in regard to the shoulder 109 and the hanger stem 130. The shoulder 109 is set back from the stem 130 sufficiently so that the fingers or skin of one operating the hanger 100 will be much less likely to be pinched between the recessed shoulder 109 at the proximal ends of the hanger arms and the hanger stem 130 when opening the arms toward the fully open and latched position shown in FIG. 1.

I claim:

1. A collapsible clothes hanger comprising:

a) a hook member;

b) an anchor body supported by said hook member, said anchor body including a pivot member mounted therein, said pivot member having opposite pivot ends disposed proximal to opposite sides of said body, defining a pivot axis extending there through;

c) a pair of hanger arms comprising:

d) respective proximal and distal ends and respective spaced apart, opposite lateral sides with respective top and bottom edges;

e) said arms disposed with each of said proximal ends disposed adjacent to said opposite sides of said anchor body and with said distal ends extending away from said anchor body;

f) said proximal ends further comprising respective rotatable supports to said opposite pivot ends of said pivot member so that said distal ends are rotatable over about ¼ of a full rotation about said pivot axis from a fully closed position with said respective bottom edges disposed proximal to each other, to a fully open position in which said distal arm ends project away from said anchor body and essentially opposite to each other;

g) a first stop member defined on one of said proximal arm ends and a second stop member defined on the other of said proximal arm ends, said $1^{st}$ and said $2^{nd}$ stop members arranged to contact each other and prevent said arms from rotating beyond said fully open position;

h) a latch mechanism operable to automatically latch each one of said arms to said anchor body in a full open and latched mode when said each arm is moved into said full open position from a less than full open position;

i) a release mechanism operable to release said latch mechanism on each one of said arms, so that said each one of said arms can be rotated from said full open and latched mode toward a less than full open position;

j) a resilient urging member continuously acting to force said pair of arms to rotate away from each other about said pivot member from said fully closed position, through said less than fully open position toward said fully open position.

2. The collapsible clothes hanger as set forth in claim 1, in which said latch mechanism comprises:

a) a blocking stud projecting inward, parallel to said pivot axis, from an inside surface of an adjacent proximal arm end;

b) wherein said anchor body comprises:

i) a sidewall having an upper portion and a lower portion defining a blocking cantilever;

(1) wherein said cantilever has a cross section defined by an inside cantilever face and an opposite outside cantilever face between an entry edge and an opposite blocking edge so that said cantilever is laterally rigid and axially flexible with respect to said pivot axis;

(2) wherein said cantilever extends from a proximal fixed end at said side wall upper portion to a distal free end;

(3) wherein said stud is located on said arm so that it is adjacent to said blocking edge when said arm is in the fully open position;

(4) wherein said blocking stud and said blocking wedge cross section are proportioned so that contact of said blocking stud with said blocking edge prevents further rotation of said blocking stud and said arm when said arm is rotated from said fully open position toward said closed position.

3. The collapsible clothes hanger as set forth in claim 2, wherein said entry edge has a thickness narrower than said blocking edge.

4. The collapsible clothes hanger as set forth in claim 3, wherein said entry edge thickness is less than the difference between the blocking edge thickness and the projection depth of the blocking stud, whereby frictional wear between the entry edge and the stud are reduced.

5. The collapsible clothes hanger as set forth in claim 1, in which said release mechanism comprises a) A longitudinal cantilever release tongue formed in a proximal portion of a side panel of one of said arms by a U-shaped slot extending through said side panel and defining a proximal fixed edge and a distal free end;

b) a release button disposed at said distal free end projects outward form said side panel, parallel to said pivot axis and disposed adjacent to an outer edge perimeter of said side panel portion;

c) said cantilever release tongue and a blocking cantilever disposed on the same one of said opposite anchor body sides, cooperate to release said arm from said locked position when said release button is pressed inward toward said anchor body and an inside surface of said tongue bears against a facing outside surface of said blocking cantilever, with sufficient force to move said locking cantilever inward, toward said anchor body a sufficient distance so that an adjacent blocking stud disposed on said same one of said anchor body sides is not impeded from further rotation past said blocking cantilever when rotating from said fully open, latched position.

6. The collapsible clothes hanger as set forth in claim 1, further comprising:

a) A shoulder recess disposed on a proximal top surface of said hanger arms having a set back from said hook member sufficient to prevent fingers or skin of one operating said hanger from being pinched between said proximal arm end and said hanger when opening said hanger arms toward or into said fully open and latched position.

7. The collapsible clothes hanger as set forth in claim 1, in which said resilient member comprises:

a) Two channel sidewalls spaced apart to receive a spring coil disposed around a cylindrical mounting tube fixed to said anchor body coaxial with said pivot axis, said spring coil having a pair of lateral spring arms extending in opposite directions in said channel parallel to said sidewalls and below said hanger support;

b) Said spring coil having a winding diameter larger than the OD of said cylindrical mounting tube;

c) Said coil spring and oppositely directed spring arms proportioned so that said spring arms proportioned so that the contact the respective opposite underside of the hanger arms 104. The spring arms 322, 324 thus provide restoring force 129 to each hanger arm tending to cause them to move toward the fully open-locked position of FIG. 1 when the restoring force 129 exceeds the load force 126 exerted by clothes hung on hanger 100.

* * * * *